US007202448B2

(12) United States Patent
Hauner

(10) Patent No.: US 7,202,448 B2
(45) Date of Patent: Apr. 10, 2007

(54) DEVICE FOR FIRING CERAMIC FOR DENTAL PROSTHESES

(75) Inventor: Wigbert Hauner, Langen (DE)

(73) Assignee: DENTSPLY International Inc., York, PA (US)

( * ) Notice: Subject to any disclaimer, the term of this patent is extended or adjusted under 35 U.S.C. 154(b) by 0 days.

(21) Appl. No.: 10/518,964

(22) PCT Filed: Jun. 18, 2003

(86) PCT No.: PCT/US03/19327

§ 371 (c)(1),
(2), (4) Date: Dec. 20, 2004

(87) PCT Pub. No.: WO04/001311

PCT Pub. Date: Dec. 31, 2003

(65) Prior Publication Data

US 2005/0184041 A1 Aug. 25, 2005

(30) Foreign Application Priority Data

Jun. 20, 2002 (DE) ..... 102 27 566

(51) Int. Cl.
*F27B 5/14* (2006.01)
*R27B 17/02* (2006.01)

(52) U.S. Cl. ..... 219/408; 219/390; 219/399; 373/111; 373/119

(58) Field of Classification Search ..... None
See application file for complete search history.

(56) References Cited

U.S. PATENT DOCUMENTS

| | | | | |
|---|---|---|---|---|
| 2,765,361 | A * | 10/1956 | Capita | 373/119 |
| 2,942,223 | A * | 6/1960 | Lennox et al. | 219/544 |
| 3,406,275 | A * | 10/1968 | Pedrotti | 219/406 |
| 3,952,408 | A | 4/1976 | Docx | |
| 6,157,004 | A | 12/2000 | Bizzio | |
| 6,252,202 | B1 | 6/2001 | Zychek | |

FOREIGN PATENT DOCUMENTS

| | | |
|---|---|---|
| DE | 43 03 458 | 1/1994 |
| DE | 43 02 570 | 3/1994 |
| EP | 0 079 730 | 5/1983 |
| EP | 0 087 111 | 8/1983 |
| GB | 1 585 458 | 3/1981 |
| WO | WO 04/001311 | 12/2003 |

* cited by examiner

*Primary Examiner*—Joseph Pelham
(74) *Attorney, Agent, or Firm*—Douglas J. Hura; James B. Bieber; Daniel W. Sullivan

(57) ABSTRACT

A heating muffle for a muffle kiln for the production of a dental ceramic product containing titanium, which comprises a hollow unit, which is provided with at least one opening for the uptake of the ceramic product and has completely heatable inner walls, an which can form together with a pedestal a firing chamber in which the ceramic product is heated by the inner walls, wherein the hollow unit comprises at least one spirally bent tube containing a heat conductor for a uniform heat transfer to the product and in order to avoid temperature gradients.

5 Claims, 2 Drawing Sheets

DEVICE FOR FIRING CERAMIC FOR DENTAL PROSTHESES

The present invention concerns a heating muffle for a muffle kiln for the production of a dental ceramic product containing titanium according to claim 1, a method for the production of such a heating muffle, as well as a muffle kiln containing the heating muffle.

Heating muffles as a component of dental ceramic muffle kilns have been known for a long time. They are comprised of refractory ceramics, ceramic fibers or quartz as a support material. A heating element is usually spirally shaped or of helical or zigzag shape fixed in the support material. The heating element is usually inserted in a groove milled in the support material, or it is attached in a tube of fused quartz or quartz glass. These heating muffles are constructed of a hollow unit comprised of a cylindrical tube, which is open on both ends, and which has corresponding fixtures for the heat conductor. Incorporated in the muffle kiln, these heating muffles are sealed on top by an insulating plate and on the bottom by an insulating pedestal for firing. It is a disadvantage in this construction that the complete inner wall construction of the hollow unit cannot be heated. Therefore, when the unit is heated up, a rather large outflow of heat occurs through the two unheated surfaces. i.,e., the insulating plate and the pedestal, whereby a particularly intense heat outflow occurs via the upper insulating plate. Therefore, vertical and horizontal temperature gradients occur that are unfavorable for the article to be fired.

Temperature gradients are a particular disadvantage when a dental ceramic product containing titanium is to be fired. Titanium has a behavior that is specific for this metal. A phase jump occurs at 822° C., which leads to a volume change of the titanium. Therefore, in the production of dental ceramic products containing titanium, one must avoid exceeding this temperature. For dental ceramic products containing titanium, special low-melting ceramic compounds were developed, which melt just below 822° C. and require an exact firing temperature. Therefore, the creation of a muffle kiln and a heating muffle which assure a uniform heat transfer to the product and avoid temperature gradients has been desired.

A muffle is known from U.S. Pat. No. 6,157,004, which has a cylindrical hollow unit, which is sealed on one end with a flat cylindrical cover. The inner wall can be completely heated by heating wires provided in the muffle. The electrical heating wires are spaced at certain distances from one another inside the cylindrical hollow unit and can be turned on or off separately from one another by means of a control unit. The heating wires are turned on or off corresponding to a preset threshold value by two temperature sensors which are arranged at two different levels in the firing chamber of the muffle kiln. In this way, a uniform heating of the ceramic products to be fired in the kiln is achieved and temperature gradients are avoided. This muffle, however, does not solve these problems. In contrast, it has several disadvantages.

First of all, an expensive temperature regulation is necessary. This temperature control, however, reacts only very sluggishly and slowly to a temperature gradient, since the heating wires lie way inside the cylinder walls and they are at a far distance from the inner walls of the cylinder, so that relatively large temperature fluctuations result during operation of this heating muffle, despite the expensive control. This temperature regulation leads to temperature differences and temperature gradients on the inner wall of the hollow unit of the heating muffle. Locally overheated regions and points occur, so-called "hot spots", which do not permit a uniform heat transfer to a ceramic product and an exact temperature program for a firing process with this heating muffle.

Secondly, the muffle described in U.S. Pat. No. 6,157,004 can take up at least two ceramic products. These ceramic products are arranged on top of a pedestal along the circumference, which pedestal, together with the muffle, forms the firing chamber. In this way, each individual dental ceramic product is rotated around an axis, which is parallel to the cylinder axis of the muffle. During their rotation, the individual ceramic products are cooled on their side turned away from the inner wall of the muffle during firing. The side turned toward the inner wall lies closer to the inner wall of the muffle, by which the ceramic product is heated, while on the other hand, the side turned away from the inner wall is further distanced from the heat source. Therefore, during rotation, a temperature gradient necessarily arises between the side of the ceramic product turned toward the inner wall and the side turned away from the inner wall, when the ceramic product is fired. For this reason also, the heat transfer to the ceramic product to be fired is nonuniform.

The object of the present invention is thus to present a heating muffle for a muffle kiln for the production of a dental ceramic product containing titanium, with which a uniform heat transfer can be made in a simple way to a dental ceramic product, and temperature gradients can be avoided during firing. In addition, a method for the production of this heating muffle and a muffle kiln containing the muffle will be created.

The present invention solves the object that has been presented with a heating muffle for a muffle kiln for the production of a dental ceramic product containing titanium according to claim 1. This heating muffle comprises a hollow unit which is provided with at least one opening for the uptake of the ceramic product and has inner walls that can be completely heated. Together with a pedestal, the heating muffle can form a firing chamber, in which the ceramic product is heated by the inner walls. The hollow unit comprises at least one spirally bent tube containing a heat conductor for a uniform heat transfer to the dental ceramic product and in order to avoid temperature gradients.

By the simple construction of the spirally shaped tube containing a heat conductor and the construction of the heating muffle as a hollow unit with inner walls that can be completely heated, on the one hand, a uniform and direct heat transfer can be made onto the ceramic product from uniformly heatable inner walls of the hollow unit constituted by the tube containing the heat conductor and, on the other hand, an outflow of heat through an unheated part of the hollow unit and thus a temperature gradient can be avoided. The entire inner walls of the hollow unit of the heating muffle according to the invention can be heated rapidly in this way and heating up can be easily controlled by applying voltage to the heat conductor. Therefore, with the exception of the pedestal, the entire inner walls of the firing chamber are completely heated. Locally overheated regions on the inner walls of the hollow unit will be avoided and a ceramic product can be heated uniformly essentially without temperature fluctuations by the inner walls of the hollow unit. Heat transfer is produced uniformly. Temperature gradients will be avoided. A regulation of different heat conductors that can be controlled by turning them on and off is thus not necessary. Different temperature zones on the inner walls and temperature gradients on the inner walls of the firing chamber will be avoided, which necessarily occur in devices of the prior art due to the delay in the temperature regulation of different regions in the firing chamber.

In addition, the present invention provides a method for the production of the heating muffle according to the invention. Thus, for forming the hollow unit having heatable inner walls, a tube containing a heat conductor is spirally arranged.

Also, a new and advantageous muffle kiln is created, which contains the heating muffle according to the invention.

Other advantageous embodiments of the present invention result from the subclaims.

DESCRIPTION OF THE DRAWINGS

The present invention will now be explained on the basis of the attached drawings. Here:

FIG. 1 shows a heating muffle 10 according to the invention. It comprises a hollow unit, which is provided for the uptake of a ceramic product (not shown) with an opening 11. The opening of the hollow unit is aligned toward the bottom in the operating position and can act together with a pedestal (not shown) to form a firing chamber after taking up the ceramic product. The muffle according to the invention can be used, for example, in the muffle kiln described in EP-A-0 087,111, but may also be used in any other common muffle kiln. The hollow unit is comprised of a cylinder sealed with a cylinder cover 12 with height H and diameter D. The cylinder comprises the cylinder jacket 15 and the cylinder cover 12.

Figure 1:
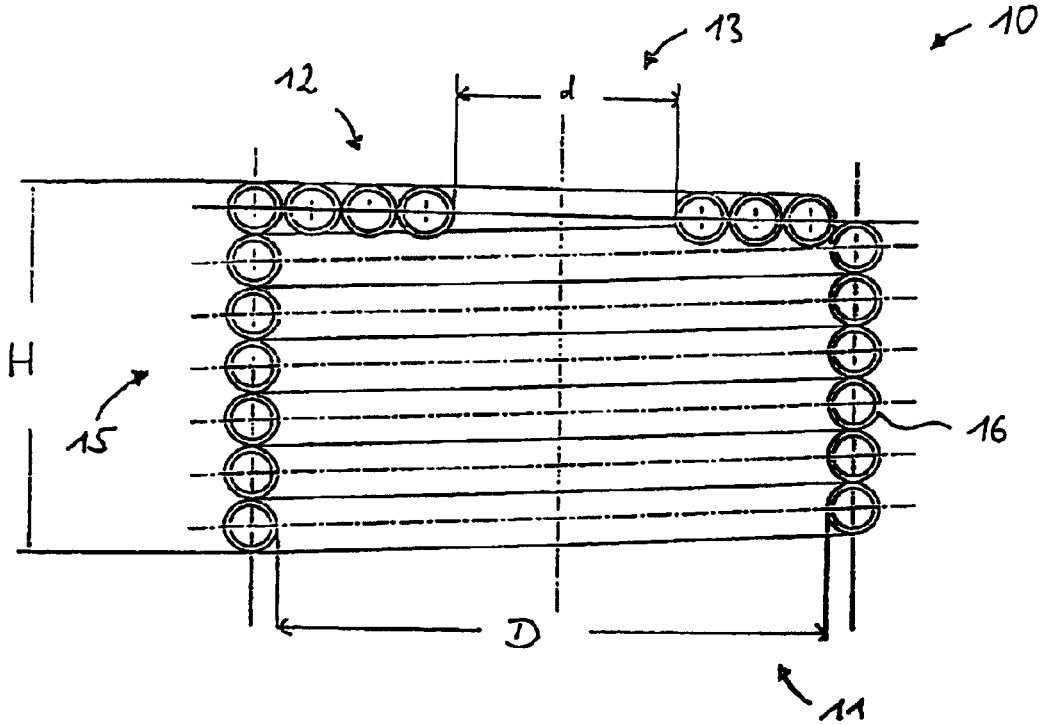
FIG. 1 shows the cross section of a heating muffle according to the invention for a muffle kiln for the production of a dental ceramic product containing titanium.
Figure 2:
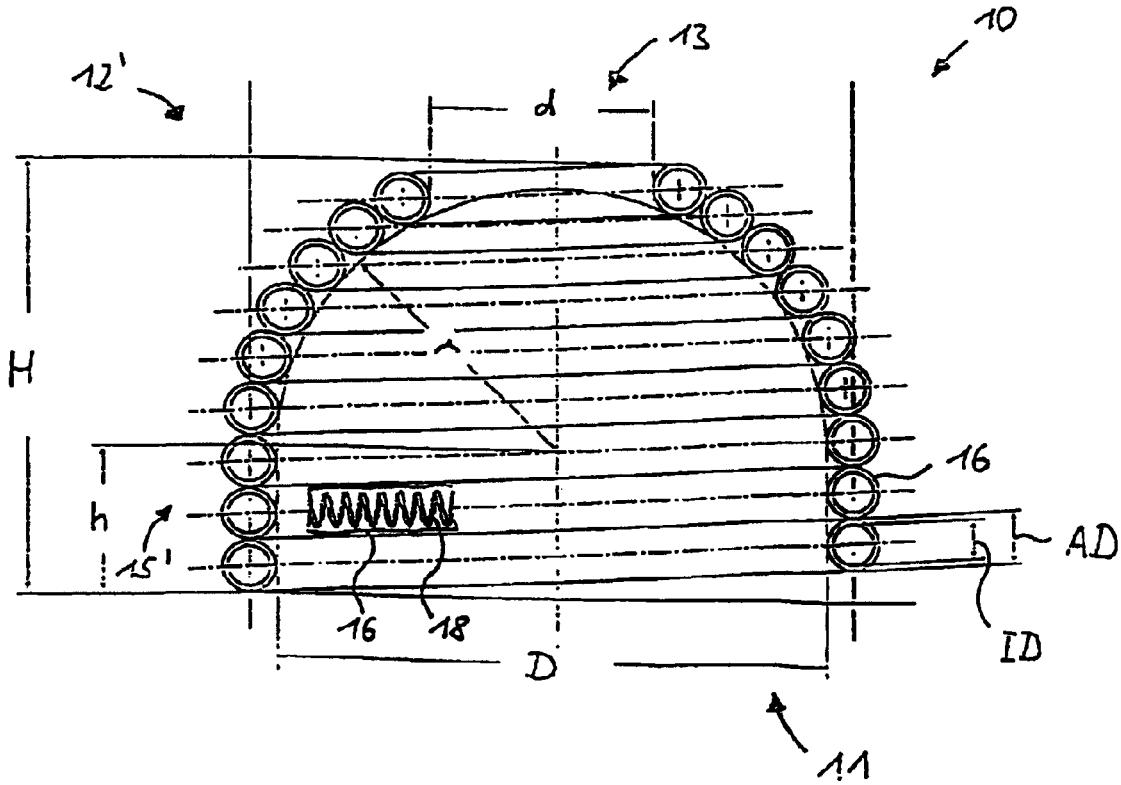
FIG. 2 shows the cross section of another heating muffle according to the invention.

The cylinder cover 12 is flat. In an alternative embodiment, however, it may also be arched, so that it is shaped like a hemisphere or like a dome, as shown in FIG. 2. The cylinder cover 12 is preferably closed. It may also have, however, another opening 13 with a diameter d for a thermocouple, as shown in FIG. 1 and FIG. 2. In the embodiment with closed cylinder cover, a thermocouple can be introduced, for example, through the pedestal into the firing chamber. The hollow unit comprises a spirally bent tube 16 containing a heat conductor for a uniform heat transfer to a ceramic product and in order to avoid temperature gradients. In a preferred embodiment, the hollow unit is comprised of a single such tube. Thus it can be produced in a simple manner. It may also comprise, however, several spirally bent tubes, if this is necessary, for example, due to the size of the muffle.

FIG. 2 shows another embodiment of a heating muffle according to the invention, wherein the elements which are also shown in FIG. 1 are characterized by the same reference numbers. The heating muffle in FIG. 2 comprises a hollow unit, which is comprised of a cylinder closed on one end with an arched cylinder cover 12'. The cylinder cover 12' is also preferably closed. The other opening 13 for a thermocouple, however, is shown in FIG. 2.

In all embodiments of the heating muffle according to the invention, the heat conductor 18 is preferably found in the wall of the tube 16. It may be arranged spirally in the bent tube 16, as shown in FIG. 2.

The wall thickness of the tube 16 may amount to 1 to 4 mm, preferably 1.5 to 3 mm, and even more particularly preferred, it is 1.5 mm. The outer diameter OD of the tube 16 may amount to 8 to 14 mm, preferably 8 to 12 mm, and even more particularly preferred, it is 10 mm. The inner diameter ID of the tube 16 may amount to 6 to 13 mm, preferably 7 to 10 mm, and even more particularly preferred, it is 7 mm.

The tube 16 may be made of quartz and preferably it is comprised of fused quartz or quartz glass. Even more particularly preferred is quartz glass. Since quartz glass is transparent, the heat transfer from the heat conductor contained in the quartz glass can be made directly onto the ceramic product as primary radiation. Therefore, the heat transfer is made in an even more uniform manner. The heating and firing processes can be more easily controlled than in a heating muffle with a hollow unit made of an opaque fused quartz tube. In the case of an opaque fused quartz tube containing a heat conductor, the heat transfer is produced by secondary radiation. The heat conductor first heats the fused quartz tube and the latter transfers the heat onto a ceramic product found in the firing chamber.

The height H of the hollow unit of the heating muffle according to the invention is not particularly limited. For example, it can amount to 50 to 150 mm, and preferably it amounts to 60 to 80 mm.

In a preferred embodiment, it amounts to approximately 70 mm when the hollow unit is comprised of a cylinder sealed with a flat cylinder cover, as shown in FIG. 1.

In an embodiment according to FIG. 2 with arched cylinder cover, the height H of the hollow unit amounts to approximately 80 mm in a particularly preferred embodiment. The height h of the cylinder jacket 15 can amount to 20 to 50 mm, and preferably it amounts to 25 to 30 mm, and even more particularly preferred, approximately 28 mm.

The diameter D of the hollow unit can amount to 70 to 150 mm. Preferably, the diameter D amounts to 90 to 130 mm. In the preferred embodiments according to FIG. 1 and FIG. 2, the diameter D of the cylinder amounts to approximately 110 mm.

The radius r of the hemispherically arched cylinder cover can amount to approximately 30 to 70 mm, preferably 40 to 60 mm, and even more particularly preferred, approximately 50 mm.

In another embodiment of the heating muffle according to the invention, which is not shown, the hollow unit is comprised of an essentially hemispherically shaped hollow unit or an essentially spherically shaped hollow unit, wherein this hollow unit preferably has a diameter D and a radius r with the values described above for the other embodiments. In this embodiment, which is not shown, an even more uniform heat transfer onto the ceramic product is produced than in the embodiments shown in FIG. 1 and FIG. 2.

A central arrangement of the ceramic product on the pedestal, which forms the firing chamber together with the muffle in the operating position, is particularly advantageous. For the central arrangement of a ceramic product in an essentially spherically shaped hollow unit, the pedestal can have a raised part in the center on which is positioned the ceramic product for the firing process, so that in the operating position, the ceramic product is found approximately in the central point of the essentially spherically shaped hollow unit. In addition, the embodiments with the essentially hemispherically shaped hollow unit or with the essentially spherically shaped hollow unit, which are not shown, may also have another opening for a thermocouple, in addition to the opening for the uptake of the ceramic product.

The diameter d of the other opening 13 for a thermocouple can amount to 8 to 50 mm and preferably it amounts to 8 to 40 mm, in all embodiments.

Figure 3:
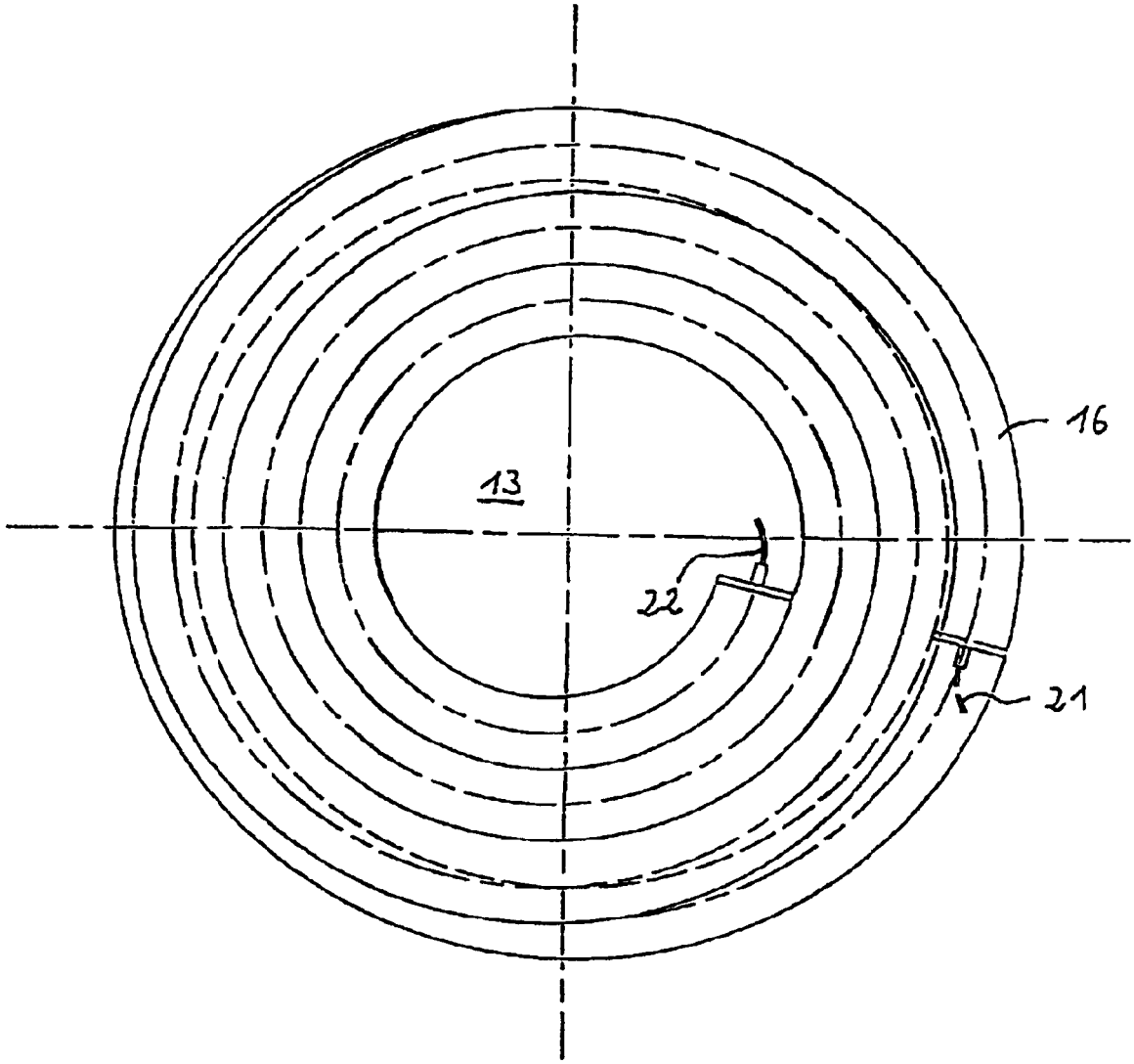
FIG. 3 shows the top view onto the heating muffle according to FIG. 2.

FIG. 3 shows a top view onto the heating muffle according to FIG. 2. It comprises a single tube 16 containing a heat conductor which is spirally arranged for forming the hollow unit having heatable inner walls. Electrical connections 21 and 22 are found on the ends of the spirally arranged tube 16, by means of which the heat conductor contained in tube 16 can be supplied with voltage.

In the method for the production of the heating muffle according to the invention, as can be seen in FIG. 3, a tube 16 containing a heat conductor 18 for forming the hollow unit having heatable inner walls is spirally arranged. The pitch of the spirally shaped arrangement results from the above-given values of the tube and the shape of the hollow unit.

Thus, tube 16 can be arranged spirally relative to a cylinder comprised of a cylinder jacket 15 or 15' and a cylinder cover 12 or 12' sealing the cylinder on one end. For the formation of an arched cylinder cover 12', the tube can be arranged spirally with a smaller radius relative to cylinder jacket 15', so that the heating muffle shown in FIG. 2 can be produced.

In order to form a flat cylinder cover 12 with a smaller radius relative to cylinder jacket 15, the tube can be arranged spirally whereby the spiral shape in the region of the cylinder cover 12 does not have a pitch, so that the heating muffle shown in FIG. 1 is obtained.

Tube 16, however, can also be arranged spirally for an essentially hemispherically shaped hollow unit or an essentially spherically shaped hollow unit.

The spiral arrangement of the tube 16 containing a heat conductor can be produced on both ends in all of these methods. It may have another opening 13 for a thermocouple on the end which has the opening 11 for the uptake of the ceramic product, or also on the end which is completely closed. All of these methods offer the advantage that the milling of a groove in a support material made of ceramics or ceramic fibers is not necessary.

A new and advantageous muffle kiln contains a heating muffle according to the invention, which can be produced in a simple manner according to one of the above-described methods.

What is claimed is:

1. A heating muffle for a muffle kiln for the production of a dental ceramic product containing titanium, which comprises a hollow unit, which is provided for the uptake of the ceramic product with at least one opening (11) and has completely heatable inner walls, and which can form together with a pedestal a firing chamber in which the ceramic product is heated by the inner walls, is hereby characterized in that the hollow unit comprises at least one spirally bent tube (16) containing a heat conductor (18) for a uniform heat transfer to the product and in order to avoid temperature gradients.

2. The heating muffle according to claim 1, further characterized in that the opening (11) of the hollow unit is aligned toward the bottom in the operating position and can act together with a pedestal to form the firing chamber after taking up the ceramic product.

3. The heating muffle according to claim 1 or 2, further characterized in that the hollow unit is comprised of a cylinder sealed on one end with a cylinder cover (12; 12').

4. The heating muffle according to claim 3, further characterized in that the cylinder cover is flat (12) or arched (12').

5. The heating muffle according to one of claims 1 or 2, further characterized in that the hollow unit is essentially hemispherically shaped or essentially spherically shaped.

* * * * *